US009815526B2

(12) United States Patent
Sundqvist et al.

(10) Patent No.: US 9,815,526 B2
(45) Date of Patent: Nov. 14, 2017

(54) SUCTION PILE

(71) Applicant: FMC Kongsberg Subsea AS, Kongsberg (NO)

(72) Inventors: Gøran Sundqvist, Sandefjord (NO); Hans Kristian Medbøen, Mjøndalen (NO); Renny Kunkel, Frederikssund (DK)

(73) Assignee: FMC Kongsberg Subsea AS, Kongsberg (NO)

( * ) Notice: Subject to any disclaimer, the term of this patent is extended or adjusted under 35 U.S.C. 154(b) by 0 days.

(21) Appl. No.: 15/026,244

(22) PCT Filed: Aug. 26, 2014

(86) PCT No.: PCT/EP2014/068069
§ 371 (c)(1),
(2) Date: Mar. 30, 2016

(87) PCT Pub. No.: WO2015/043856
PCT Pub. Date: Apr. 2, 2015

(65) Prior Publication Data

US 2016/0244128 A1 Aug. 25, 2016

(30) Foreign Application Priority Data

Sep. 30, 2013 (NO) ..... 20131307

(51) Int. Cl.
*E02B 17/02* (2006.01)
*B63B 21/27* (2006.01)
(Continued)

(52) U.S. Cl.
CPC ..... *B63B 21/27* (2013.01); *E02D 7/20* (2013.01); *E02B 2017/0078* (2013.01); *E02D 27/525* (2013.01); *E02D 2250/0053* (2013.01)

(58) Field of Classification Search
CPC ..... B63B 21/27; E02B 2017/0078; E02D 27/52; E02D 27/525; E02D 2250/0053
(Continued)

(56) References Cited

U.S. PATENT DOCUMENTS 3,496,900 A * 2/1970 Mott ..... B63B 21/27 114/296
3,640,075 A * 2/1972 La Peyre ..... E02B 3/068 405/224.1
(Continued)

FOREIGN PATENT DOCUMENTS

GB 2 010 202 A 6/1979
WO WO 2008/012414 A2 1/2008
(Continued)

*Primary Examiner* — Frederick L Lagman

(57) ABSTRACT

The invention relates to a suction pile comprising a cylinder shaped body (1) with a closed end (3) and an open end (2), means (4) for attaching an arrangement to ejecting entrapped water, air and mud, but also provide a pressure difference within the suction pile during installation, and an attachment system (10) for attaching external equipment to the suction pile, the suction pile is formed with a skin portion (17) and at least one flange portion (6). At least one of the flange portions (6) comprises an element (11, 26) that form at least a part of the attachment system (10) for external equipment.

12 Claims, 6 Drawing Sheets

(51) Int. Cl.
*E02D 27/52* (2006.01)
*E02D 7/20* (2006.01)
*E02B 17/00* (2006.01)

(58) Field of Classification Search
USPC ..... 405/224.1, 226; 114/296
See application file for complete search history.

(56) References Cited

U.S. PATENT DOCUMENTS 4,109,477 A * 8/1978 Vogel ..... E02B 17/02 405/207
4,432,671 A * 2/1984 Westra ..... B63B 21/27 114/296
4,575,282 A * 3/1986 Pardue, Sr. ..... E02D 5/42 114/296
5,852,985 A * 12/1998 Fisher ..... B63B 21/26 114/296
6,009,825 A * 1/2000 Fulton ..... B63B 21/22 114/294
6,719,496 B1 * 4/2004 Von Eberstein ..... B63B 21/22 114/296
7,407,342 B2 * 8/2008 Seidel ..... E02B 17/00 405/224
7,527,455 B2 * 5/2009 Raines ..... B63B 21/27 114/296
7,661,905 B2 * 2/2010 Alhayari ..... B63B 21/27 114/296
8,025,463 B2 * 9/2011 Foo ..... B63B 21/27 405/224

FOREIGN PATENT DOCUMENTS

WO WO 2010/068119 A1 6/2010
WO WO 2010068119 A1 * 6/2010 ..... B63B 21/27
WO WO 2012/062693 A1 5/2012
WO WO 2014/175751 A1 10/2014

* cited by examiner 14a
14
22
13
21
12

14
22
13
21

14
13

14
22
13
21

22
13
14
22
21

14
14
13
22
21

SUCTION PILE

The present invention relates to a suction pile with an external attachment assembly for attaching structures, especially subsea structures, to the suction pile.

BACKGROUND OF THE INVENTION

Suction piles, piles or caissons have been used subsea to anchor floating vessels or to form a foundation for a subsea structure. A suction pile, or suction anchor, is formed as a cylinder shaped object which is open at one end and closed at the other end, and with a system for pumping out fluid from the inside of the cylinder shaped object through the close end.

When the suction pile is installed, the open end is positioned on the seabed. Due to the weight of the structure, and by pumping out fluids through the closed end to create a suction pressure in the structure, the open end of the structure is forced, or driven, down into the seabed until a given height of the suction pile is positioned below the seabed surface. The anchor is kept in place by a combination of friction forces between the cylinder shaped wall of the suction pile and the seabed. By this, a sturdy foundation or anchoring point in the seabed is achieved. The suction pile may be used to anchor a floating vessel or as a foundation upon which may position and anchor a seabed structure, as for instance a template for a part of a subsea oil production facility. A subsea structure may be anchored to one or several suction piles. One subsea template may for instance be positioned with a suction pile in each of the four corners of the template.

Normally such suction piles are formed from a metallic material, and the subsea structures are normally welded to these suction piles or fastened to fastening means which are welded to the closed end of the suction piles. Some examples of known suction piles are described in International Publication Nos. WO 2012/062693, WO 2008/012414 and WO 2010/068119. A possible new way of forming a suction pile is to form it from a composite material, thereby reducing the weight of the suction pile structure compared to a structure made of steel. However, a subsea structure that is to be anchored and positioned on top of a suction pile is normally of a different material than composite material, making the use of standard/well known attachment system difficult, if not impossible.

There is therefore a need to provide a system for connecting or attaching a subsea structure or an anchor line for a floating vessel to a suction pile which will work if the suction pile is made of a composite material.

Another need exists to provide an attachment or connection system such that the structural strength of the suction pile, possibly made of a composite material, is maintained.

A suction pile is positioned and kept in the seabed by creating suction within the anchor; hence, there is a need to provide a suction pile with an attachment system which does not pose a risk of leakage into the interior of the suction pile.

The invention is set forth and described in independent claim 1, while other characteristics of the invention are identified in the dependent claims.

SUMMARY OF THE INVENTION

According to the invention there is provided a suction pile which may be made of composite material and which provides a solution to at least some of the above mentioned needs or eliminates or alleviates some of the problems with the known solutions.

A suction pile is provided comprising a cylinder shaped body with a closed end and an open end. The suction pile includes means for attaching an arrangement to create a suction pressure within the suction pile during installation. An attachment system for external equipment is also provided.

According to the invention the cylindrical shaped body and closed end are formed with skin portions and flange portions. At least one of the flange portions comprises an element that forms at least a part of the attachment system for external equipment. The suction pile may be formed from one or several segments comprising a skin portion and a flange portion.

A flange portion should in this application be understood to be a portion of a segment forming the suction pile or, alternatively, forming a part of the suction pile, which segment has an increased strength in at least one direction compared with other parts of the segment next to the flange portion. This other part of the segment is normally referred to as a skin portion. This increased strength may be achieved in several manners. One possible configuration of the flange portion would be to have the flange portion formed with an increased thickness in at least one direction compared to the skin portion. This increased thickness may be formed by a flat rim, a collar, a rib or a similar element. If a segment is made mainly from a "sheet" having an even thickness, the flange portion would comprise a part of the sheet which is bent and extends in a mainly transverse or different direction compared to the rest of the segment, i.e., the skin portion. The flange portions may be formed at the sides of a segment or they may be formed independently and combined with the sides of a segment.

The suction pile may be made of two, three, four, five, six, seven, eight, nine or more segments. One possible way of making a suction pile of segments is described in Norwegian patent application No. XXXXX by Sørkomp A S. The segments comprise a skin portion and flange portions. The flange portions of the segments which face another segment during use are used for connection of the segments to each other to form the suction pile. The segments may also comprise flange portions that do not face another segment. Such a flange portion may be positioned at a midline of a segment or symmetrically about a midline of a segment.

The attachment system may comprise an arrangement making it possible to attach a subsea structure to the suction pile; alternatively, the attachment system may comprise means for attaching an anchor line to the suction pile. An element formed at the flange portion may be the attachment system, or it may form part of the attachment system. The element may be a recess in the flange portion and/or an extension of the flange portion. The attachment system may be a system with only one point for connection to an external structure, or it may be a system with several points for connection. The attachment system may also be a system with several connections to the segments of the suction pile, which together, through the attachment system, form one connection point to the external structure. There may also be solutions with groups of connection points to the segments forming one connection point to the external structure, or a combination of the solutions described above. The attachment system is provided with one element at least in part formed at the flange portion of at least one segment.

With a solution according to the invention, the suction pile bears the weight of a subsea structure which is positioned on top of and connected to the suction pile. Loads are transferred to the suction pile at points where the material of the suction pile is strengthened, i.e., the connection points are primarily not made in the skin portions of the segments. As the flange portions of two neighboring segments are attached to each other, they provide a combined structure part of the suction pile with increased strength compared to the rest of the segments. With an attachment system according to the invention, the structural integrity of the suction pile is maintained.

According to an aspect of the invention the flange portion comprising an element forming part of the external attachment system may extend from the closed end and at least partly along the cylindrical shaped body of the suction pile. A suction pile would normally be connected to an external structure at the closed end of the suction pile, as this end faces up from the seabed. By having the external attachment system provided in the flange portions of the segments, which extend from the closed end and into or along the cylindrical wall of the suction pile, the loads from the external system are transferred from the closed end of the suction pile down into the walls and thereby into the soil around the suction pile.

According to another aspect of the invention the flange portions may extend into the interior of the cylinder shaped body and the closed end. When a subsea structure is positioned on top of one or several suction pile(s), the load transfer is favorable with flange portions extending into the interior of the suction pile. The load transfer may be even better by giving the flange portions a strengthened configuration. One possibility would be to form the flange portion with a sort of triangular shaped part between the closed end and the cylindrical wall. A second possibility is to have the flange portion for connection of the segments to each other extending into the interior of the suction pile, and have an extension of the flange portion forming part of the attachment system extending out of the suction pile. A third possibility is to have a flange portion extending into the interior of the suction pile and also have a flange portion extending out from the suction pile. A fourth possibility is to have the flange portions positioned extending out from the suction pile.

According to another aspect of the invention the element forming at least a part of the attachment system may be positioned in the flange portions which face a flange portion of a neighboring segment. With such a solution one may achieve a favorable production method of the segments of the suction pile. Another possibility is to form the flange portions in the skin of the segments such that the flange portion forms an element which forms part of the attachment system.

According to another aspect of the invention at least one segment may be formed of a composite material. According to the invention the possibility also exists to have all the segments or a majority of the segments formed by a composite material. One possible configuration is to have most of the segments formed by a composite material and one or two of the segments formed of a metallic material or reinforced or coated by a metallic material. By having all or a majority of the segments made of a composite material would result in a reduced weight of the suction pile, which is favorable. However, this introduces the challenge of both providing an attachment system for metallic subsea structures and providing a structure that may handle the loads from a subsea structure. This is solved with a suction pile according to the present invention with the attachment system at least in part formed by flange portions of the segments forming the suction pile.

According to another aspect of the invention the cylinder shaped body with the closed end forms a cylindrical wall portion and an end portion, where most of the segments may be substantially equal and each segment forms a part of the cylindrical wall portion and a part of the closed end portion. One possibility may be to provide all the segments of equal shape. The segments would then form cake pieces of the suction pile, all meeting in the middle of the closed end of the suction pile. In another embodiment all but one of the segments have an equal shape, and the one segment of unequal shape is positioned in the center of the closed end forming a round flat segment and the other segments form cake pieces around this one round segment. Even though the segments are said to have an equal shape, they may not be equal, as some may have means for attaching a pumping system and not all may have elements forming part of the attachment system.

According to another aspect of the invention the closed end of the cylinder shaped body may comprise a flat central section and a rounded transition section connecting the flat central section with a cylindrical wall portion of the suction pile, wherein the attachment system is positioned in the flat central section of the suction pile. In one embodiment the attachment system is positioned in the flat central section close to the transition section.

In another embodiment the attachment system is positioned where the flat central section joins the transition section. By having the points of the attachment system close to or at the point between the flat section and the transfer section, the load distribution in the suction pile is favorable.

According to another aspect of the invention the attachment system may comprise at least one recess formed in at least one flange portion of at least one of the segments and at least one attachment piece having a section with a complimentary form to the recess and a base section, wherein the attachment system is configured such that when one segment is connected to a neighboring segment, the attachment piece is positioned with the first section within the recess and with the base section extending a distance out of the suction pile. According to one embodiment the recess may be formed in one of the segments, or there may be recesses in both segments which together form a common recess for the attachment system. The attachment piece may be made of a different material than the segment, thereby forming an attachment system which is possible to use when the segments are formed of a composite material and the subsea structure is formed of a metallic material. Another feature is that by having the attachment system in part positioned between the segments in recesses in the flange portions of the segments, when these are joined, the structural integrity of the suction pile is further maintained.

According to another aspect the attachment system may comprise at least three recesses, each with one attachment piece and each positioned between different neighboring segments. According to another aspect the attachment system comprises recesses in all flange portions which extend between the closed end and the cylinder wall. In another embodiment the attachment system comprises recesses in all flange portions which face a flange portion of a neighboring segment and which extend between the closed end and the cylindrical wall. By having all segments formed in a similar manner in relation to the element of the flange portion forming part of the attachment system, the production of all these segments would be the same, which is favorable.

According to an aspect of the invention the first section of the attachment piece may have a width which is larger than the width of the base section. When the attachment piece is then positioned in the recess and two segments are joined, the attachment piece is fixed relative to the segments and may not be pulled out of the recess. The first section of the attachment piece may also have a larger area in contact with the flange portions of the segments, and thereby a larger area over which the load is transferred to the segments compared to the base section of the attachment piece. The base section forms a part for attaching external equipment.

According to another aspect the attachment system may comprise a base plate connected to at least one base section and positioned on an outside of the suction pile. This will give a larger area for connecting external equipment to the suction pile.

The invention will now be explained in more detail in non-limiting embodiments and with reference to the attached drawings, wherein:

DETAILED DESCRIPTION OF THE INVENTION

Figure 1:
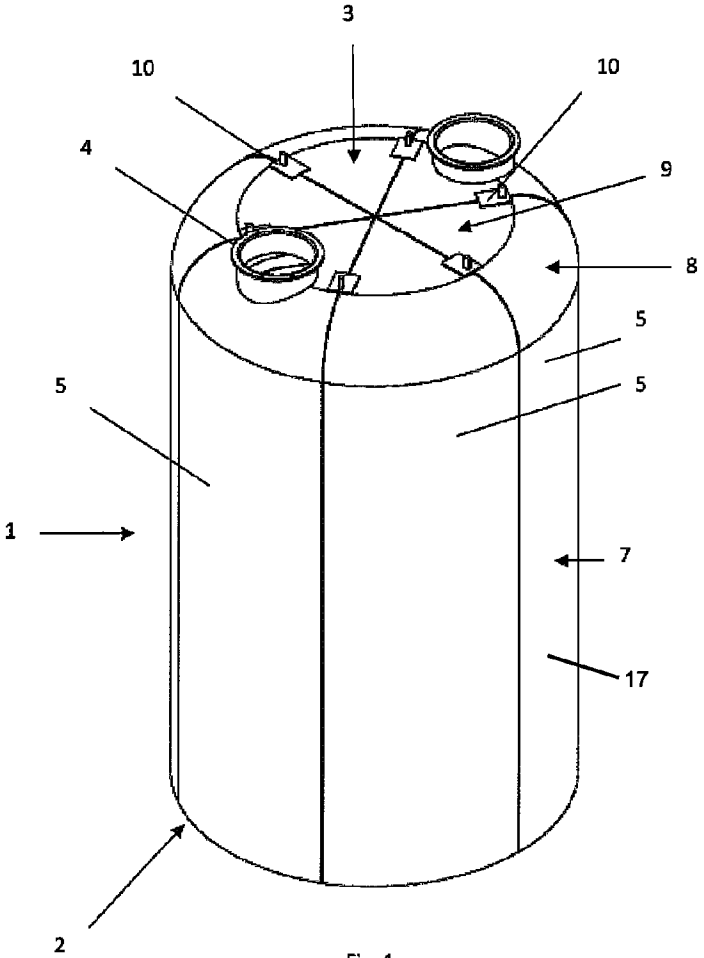
FIG. 1 is a perspective view of a first embodiment of a suction pile according to the invention.

FIG. 1 is a perspective view of one embodiment of the invention. The suction pile shown in FIG. 1 has a cylindrical shaped body 1 having an open end 2 and a closed end 3. The suction pile includes means 4 for attaching a ventilation system (not shown) for ejecting entrapped water, air and mud from the body 1. The suction pile also has means (not shown), or a part of the means 4, for attaching a pumping system for creating a suction pressure within the cylindrical shaped body 1 as the suction pile is positioned into the seabed. The suction pile is further made of a number of segments 5. In the embodiment shown in FIG. 1 the suction pile is made of six equal segments 5. In the embodiment shown in FIG. 9 the suction pile is made of one segment 5. It is of course also possible to envisage a suction pile according to the invention which is made of two, three, four, five, six, seven, eight, nine, ten, eleven, twelve or more segments. The number of segments will vary dependent on the size of the suction pile. It is also possible to envisage a suction pile with the majority of segments being equal in shape but with some segments differing in shape from the majority of segments.

In the embodiment shown in FIG. 1, each of the segments 5 has an outer skin portion 17 that comprises a portion which forms part of the cylindrical wall 7 and a portion which forms part of the closed end 3, the latter portion including a transition portion 8 and a flat portion 9. The transition portion 8 has a curvature between two linear portions with about 90 degrees difference in orientation. The radius of the curvature of the transition portion 8 will depend on the size and use of the suction pile. It is also possible to envisage a suction pile with side walls 7 and a closed end 3 where the closed end is formed in a different manner than described above. The closed end 3 may be formed with an apex in the center or with another form other than flat in one central portion. These forms may also be considered to have a central portion and a transition portion. A transition portion may comprise both curved parts and linear parts.

The suction pile also comprises an external attachment system 10 in the form of six attachment points in the embodiment shown in FIG. 1. The external attachment system is provided to connect with a subsea structure or other external structure (not shown) which needs the support of the suction pile. The attachment points of the attachment system 10 are positioned at the connections between the different segments 5 forming the suction pile.

Figure 2:
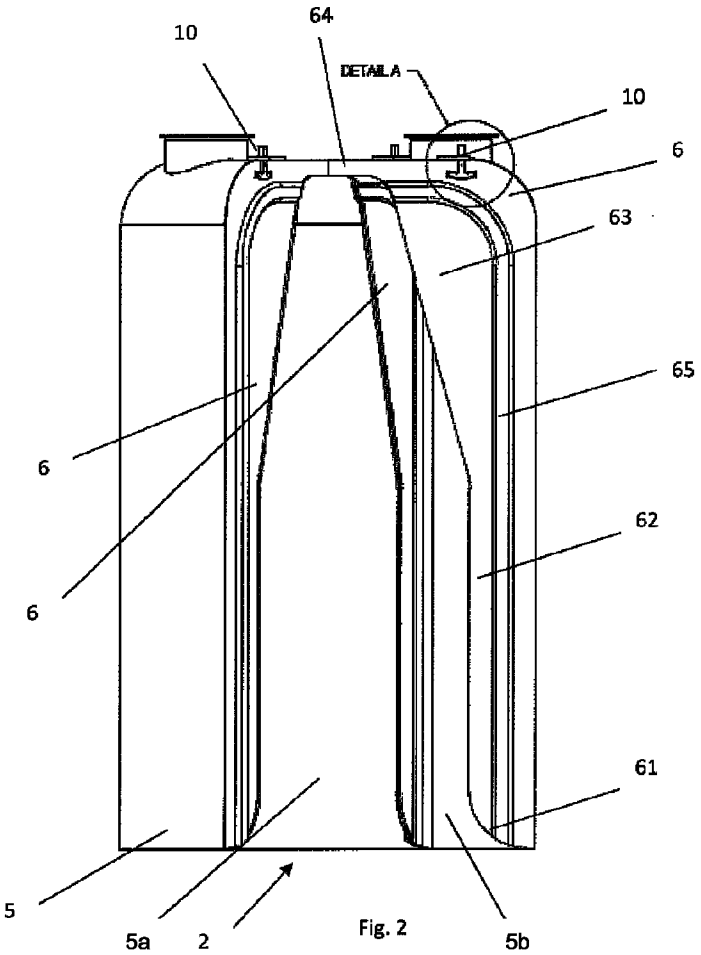
FIG. 2 is a front view of the suction pile shown in FIG. 1 with one segment removed.

As best shown in FIG. 2, each of the segments 5 forming the suction pile is formed with flange portions 6 at the sides of the segments 5 facing a neighboring segment. It is possible to see four flange portions 6 in FIG. 2, two of which are facing the removed segment, namely, a flange portion of segment 5 and a flange portion of segment 5*b*, and two of which are positioned next to each other, namely, the flange portions of segments 5*a* and 5*b* when these two segments are connected together. The flange portions 6 extend inward into the interior of the suction pile. The flange portions are also extend along the closed end 3 and along the cylindrical wall 7 of the suction pile.

The flange portions 6 in the shown embodiment are formed with a rounded lower portion 61 close to the open end 2 of the suction pile. This form will ease the movement of the suction pile into the soil of the seabed. The flange portion then continues with a straight portion 62 for a distance along the wall 7 of the suction pile. The flange portion then continues in a sort of triangular shaped portion 63 which extends from a point at the cylindrical wall 7 through the transitions portion 8 and up to the flat portion 9 of the closed end 3. The width of a flange portion is defined as the distance between the distal end of the flange portion and the skin 17 of the segment 5. The width of the flange portion varies for the triangular shaped portion 63 in the shown embodiment. The end of the triangular shaped portion 63 facing inward forms a mainly linear edge. In another embodiment this end may form a curved edge. The triangular shaped portion 63 is a portion of increased width of the flange portion compared with the other portions of the flange portion. The flange portion shown in the figure ends with an end portion 64 in the closed end 3 of the suction pile. The flange portion 6 also includes, in a surface facing a neighboring segment when connected, grooves or corrugations 65 extending along the flange portion. The grooves 65 may extend mainly parallel with the skin portion 17 of the segment. As seen in FIG. 2, the segments 5 are not provide with flange portions at sides not facing neighboring segments, which may be seen at the open end 2. The segments 5 are also not formed with flange portions at the open end 2.

These flange portions 6 of the segments 5 face inward into the suction pile. However, it is possible to envisage them facing outwards or both inwards and outwards. It is also possible to envisage the segment 5 not extending into the center of the flat portion of the closed end 3, but instead having a circular segment forming at least a part of the flat portion of the closed end. This possible circular segment may form only a smaller part of the flat portion of the closed end.

Figure 4:
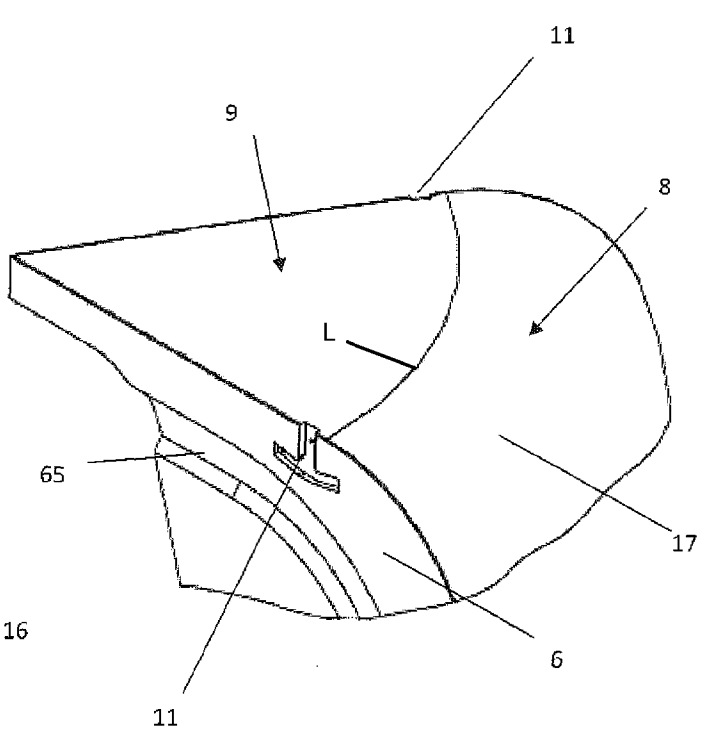
FIG. 4 is an enlarged perspective view of "Detail A" of FIG. 2.
Figure 3:
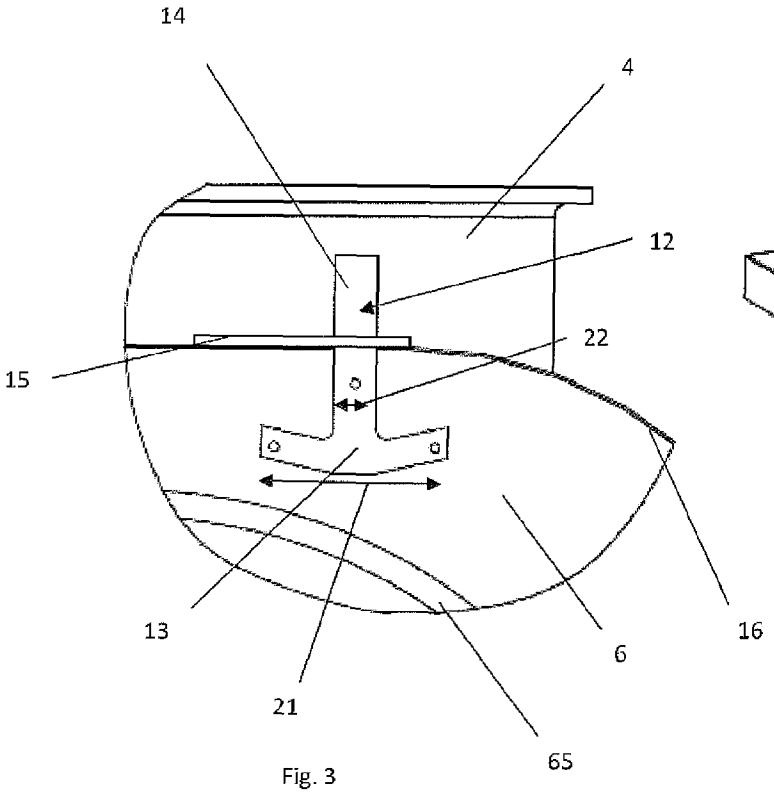
FIG. 3 is an enlarged view of "Detail A" of FIG. 2.

The external attachment system may be formed in different manners; one embodiment is shown in FIGS. 3 and 4. FIG. 3 shows Detail A of FIG. 2, and FIG. 4 shows the embodiment of FIG. 3 with part of the attachment system removed for clarity. The external attachment system comprises a recess 11 formed in the flange portion 6 or part of a segment 5, as best shown in FIG. 4. There may be a recess in the flange portion in only one of the segments or in both flange portions so that they together form a common recess 11 when connected to each other. The recess 11 is formed in the flange portion at a position which, when the segments are connected, will be at the relative outside of the grooves 65.

Within this recess 11 is positioned an attachment piece 12. If the segments 5 are made of a composite material, the attachment piece 12 may be of another material (metal, for instance steel). The attachment piece 12 is formed with a first section 13 and a base section 14. The first section 13 has a first width 21 which is larger than a second width 22 of the base section 14. The recess in the flange portion has a corresponding shape. When connected, the base section extends to the outside of the suction pile and forms a basis for attaching external equipment. The first section 13 is positioned in the recess 11 between the flange portions of two neighboring segments 5 and is kept in this position by the connection of the segments 5 to each other. The recess 11 and the attachment piece 12 have complimentary forms. Thus, the recess 11 must be large enough to accommodate the attachment piece 12 and also present a smaller width close to the skin portion 17 to keep the attachment piece locked in the recess when segments 5 are joined together. The recess 11 may be larger than the attachment piece 12. However, as with the attachment piece 12, the recess 11 has an inner part with a larger width and an outer part with a smaller width, similar to the first and second widths 21 and 22 of the attachment piece 12. If the recess 11 is larger than the attachment piece 12, the recess 11 would normally be filled with an adhesive material, for instance epoxy or a similar material, when the attachment piece is positioned within the recess. This will fill any voids and prevent movement between the attachment piece and the segments 5. In the embodiment shown in FIG. 3, the attachment piece forms a upside down T-shape with the top of the T as the first section 13 and the bottom part or root of the T as the base section 14. The top part of the T facing the outer surface 16 of the suction pile is closer to the outer surface at the distal ends than at the middle. The base section 14 extends from the first section 13 out beyond the outer surface 16 of the suction pile. A base plate 15 is connected to the base section 14 at the outside of the suction pile. If the flange portions 6 of the segments 5 extend outwards instead of inwards as in the shown example, the base section 14 of the attachment piece would extend outside an outer end of the flange portions.

As one may see from FIG. 4, the external attachment system is positioned in the flange portions 6 of the segments 5 and not in the skin portions 17 between the flange portions 6. The external attachment system is positioned in the flange portion 6 at an outer circumference of the flat portion 9 of the closed end 3, or close to where the transition portions 8 and the flat portions 9 of the closed end are connected, as indicate with the line L in FIG. 4. It is possible to envisage another point for positioning the recess and attachment piece which is in the transition portion 8 of the closed end. The closed end may as previous mentioned also be formed without the flat portions located centrally in the closed end.

Figures 5A, 5B, 5C, 5D, 5E, 5F:
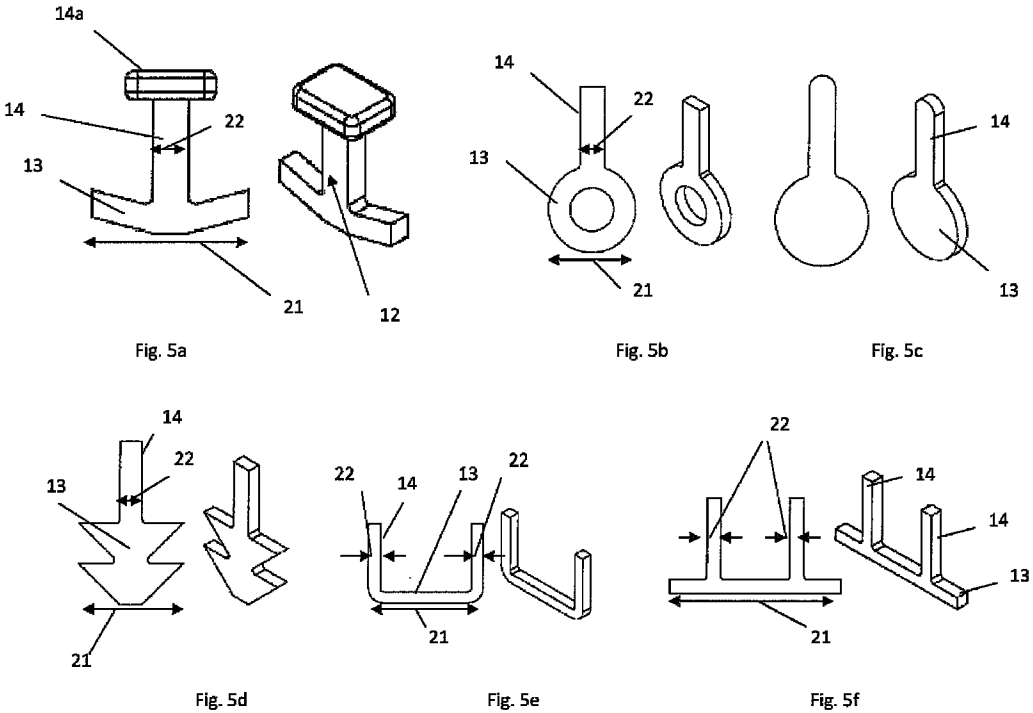
FIG. 5*a* to FIG. 5*f* are front and perspective views of different shaped attachment pieces of the invention.

The attachment piece 12 and the recess 11 may have many different shapes, some of which are indicated in FIGS. 5*a* to 5*f*. The commonality between these attachment pieces is the existence of a first section 13 with a first width 21 and a base section 14 with a second width 22. The first width 21 is larger than the second width 22 and the recess has complimentary differences in the width to thereby keep the attachment piece 12 within the recess 11 when segments 5 are connected. This is the case with the upside down T-shape in FIG. 5*a*, the upside down lollipop shape with a through going opening in FIG. 5*b*, and the upside down lollipop shape without an opening in FIG. 5*c*. It is also the case with the upside down "tree" in FIG. 5*d*, which is also a sort of T with two top bars of the T located one above the other. In FIG. 5*e* the attachment piece 12 is given a U-shape, wherein the bottom of the U forms the first section 3 and the two legs of the U together form the base section 14. In FIG. 5*f* a bar forms the first section 13 and two legs extending up from positions along this bar form the base section 14.

Figures 6A, 6B, 6C, 6D:
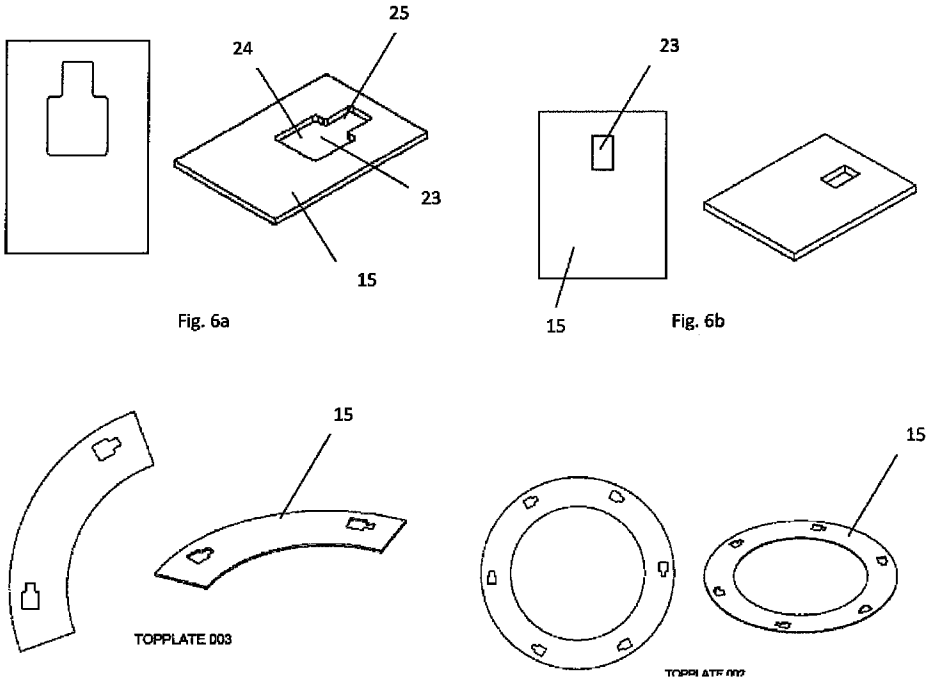
FIG. 6*a* to FIG. 6*d* are top and perspective views of different shaped base plates of the invention.

As shown in FIG. 5*a* the base section 14 may comprise a locking part 14*a* to prevent the base plate 15 from being involuntary released from the base section 14 opposite the first section 13, or possibly at a point along the base section 14 (not shown). In FIGS. 6*a* to 6*d* are shown some possible embodiments of base plates 15. In FIG. 6*a* is shown one rectangular base plate with a through going opening 23 for threading the base plate onto the base section 14 which extends out of the suction pile surface. The opening 23 also has a guide part 24 and a smaller centering part 25. The base plate may as shown in FIG. 6*b* also be made with an opening 23 in the shape of the cross section of the base section 14. The base plate may also be formed so that it can be connected to two base sections of different attachment pieces or two base sections of one attachment piece, thereby providing two openings 23 in the base plate as shown in FIG. 6*c*. In such an instance it is favorable to provide the openings with a guide part 24 and a centering part 25. As seen in FIG. 6*d*, the base plate may also be formed as one unit to be linked to all the different attachment pieces 12 in the attachment system. One possible embodiment is then to form the base plate as a ring shaped element with openings 23 for the different base sections 14. Another possibility is to provide a larger circular or other shaped plate (not shown) which is connected to all the different attachment pieces in the attachment system. The objective here is to provide a basis to position or attach external equipment on or to the suction pile while at the same time providing the necessary access for the pumping equipment which creates suction pressure within the suction pile and also enabling the loads from the external equipment to be transferred down into the suction pile.

Figure 7B:
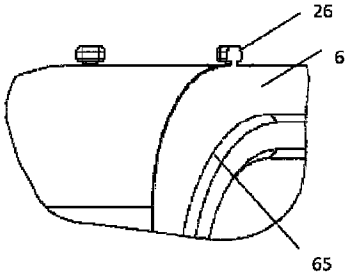
FIG. 7*a* to FIG. 7*c* are views of an alternative embodiment of an attachment system of the invention, with FIGS. 7*a* and 7*b* being two different perspective views of the system and FIG. 7*c* being a detail of FIG. 7*b;*
Figure 7C:
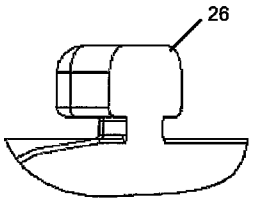
Figure 7A:
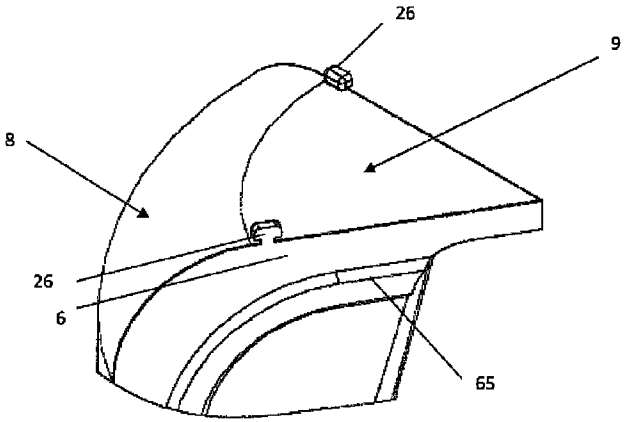

In FIG. 7 is shown a different embodiment of the attachment system according to the invention. In this embodiment the segments are formed with integral attachments pieces 26 in the flange portions 6 of the segments 5. Instead of a recess in the flange portion 6, an extension 26 from the surface of the segment forms part of the attachment system for external structures. These extensions 26 extend in the opposite direction of the main flange of the flange portion 6.

Figure 8:
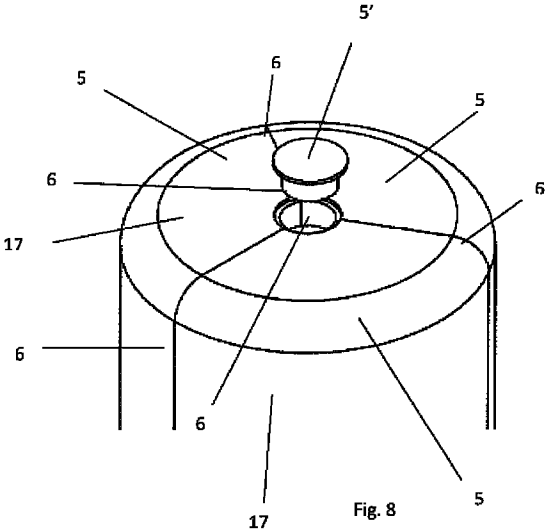
FIG. 8 is a perspective view of a second embodiment of a suction pile according to the invention.

FIG. 8 shows a second embodiment of a suction pile of the present invention. The suction pile is made up of three mainly equal segments 5, all forming a part of the closed end 3 and the cylinder wall 7 of the suction pile. In addition, an additional segment 5' is provided in the center of the closed end of the suction pile. The segments 5 are formed with skin portions 17 and flange portions 6. The flange portions 6 are provided in the connection between the segments and extend inwards into the suction pile. The additional segment 5' is also formed with a skin portion and a circular flange portion 6. The three other segments 5 are also formed with a curved flange portion 6 cooperating with the flange portions 6 of the addition segment 5'. The flange portions 6 between the three segments 5 are also formed with an element that forms at least a part of the attachment system for external equipment, in this case recesses in the connection between the flange portions 6 of neighboring segments 5 (not visible in the drawing). The configuration with a number of mainly equal shaped segments and one other formed segment in the closed end may be used with other numbers of mainly equally shaped segments.

Figure 9:
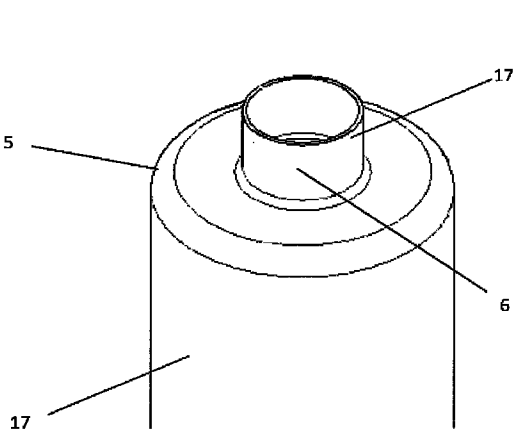
FIG. 9 is a perspective view of a third embodiment of a suction pile according to the invention.

FIG. 9 shows another embodiment of a suction pile of the invention, in which the suction pile is formed with one segment 5. The segment is formed with skin portions 17 and flange portions 6. One flange portion 6 is formed as an outward extending flange portion 6 in the closed end of the suction pile. This flange portion 6 forms an element that defines at least a part of the attachment system for external equipment. The suction pile may also be formed with other flange portions extending inward in the suction pile, which are not shown in the drawing.

The invention has now been explained and described with reference to the attached drawings. A skilled person would understand that alterations and amendments to the described embodiment may be made that are within the scope of the invention as defined in the attached claims. The flange portions may extend inwards or outwards or even in both directions. The suction pile may be formed of mainly equal segments or a majority of equal segments and some segments having another shape. Most or all of the segments may be made of a composite material.

The invention claimed is:

1. A suction pile comprising:

a cylinder shaped body having a closed upper end and an open lower end, the body comprising at least one segment which includes a skin portion and at least one flange portion; and an attachment system for attaching external equipment to the suction pile;

wherein at least one of the flange portions comprises an increased thickness in at least one direction compared to the skin portion;

wherein at least one of the flange portions comprises an element that forms at least a part of the attachment system;

wherein the flange portion comprising the element extends from the closed end and at least partly along the cylindrical shaped body; and wherein the body is formed of at least two segments.

2. A suction pile according to claim 1, wherein the flange portions extend into the interior of the cylinder shaped body and the closed end.

3. A suction pile according to claim 1, wherein each segment comprises a flange portion at each of its ends which faces a neighboring segment.

4. A suction pile according to claim 3, wherein the element forming at least a part of the attachment system is positioned in a flange portion facing a flange portion of a neighboring segment.

5. A suction pile according to claim 3, wherein the attachment system comprises:

at least one recess formed in at least one flange portion of at least one of the segments; and at least one attachment piece which comprises a first section having complimentary form to the recess and a base section which is connected to the first section;

where the attachment system is configured such that when one segment is connected to a neighboring segment, the attachment piece is positioned with the first section within the recess and with the base section extending a distance out of the suction pile.

6. A suction pile according to claim 5, wherein the attachment system comprises at least three recesses, within each of which one attachment piece is positioned, and wherein each recess is positioned between different neighboring segments.

7. A suction pile according to claim 5, wherein the flange portions facing each other are formed with mirrored recesses.

8. A suction pile according to claim 5, wherein the first section of the attachment piece has a width which is larger than a width of the base section.

9. A suction pile according to claim 5, wherein the attachment system comprises a base plate which is connected to at least one base section and is positioned on an outside of the suction pile.

10. A suction pile according to claim 1, wherein at least one segment is at least partially formed from a composite material.

11. A suction pile according to claim 1, wherein the cylinder shaped body comprises a cylindrical wall portion and the closed upper end comprises an end portion, and wherein a majority of the segments are substantially equal and each segment forms a part of the cylindrical wall portion and a part of the closed end portion.

12. A suction pile according to claim 1, where the attachment system is positioned in the closed end of the suction pile.

* * * * *